US005103989A

United States Patent [19]

Druesne et al.

[11] Patent Number: 5,103,989

[45] Date of Patent: Apr. 14, 1992

[54] METHOD OF PRODUCING A NON-CUTTING TEAR-OFF LINE AND THE PRODUCTS OBTAINED

[75] Inventors: Guy Druesne, Saint Seurin Sur l'Isle; Joel Michaud, Montpon Menestrol, both of France

[73] Assignee: Cebal, Clichy, France

[21] Appl. No.: 486,164

[22] Filed: Feb. 28, 1990

Related U.S. Application Data

[63] Continuation-in-part of Ser. No. 406,422, Sep. 11, 1989, abandoned.

[30] Foreign Application Priority Data

Sep. 12, 1988 [FR] France ..... 88 12547

[51] Int. Cl.[5] ..... B65D 41/32

[52] U.S. Cl. ..... 215/254; 215/256; 220/266; 220/276

[58] Field of Search ..... 215/253, 254, 255, 256; 220/266, 274, 276

[56] References Cited

U.S. PATENT DOCUMENTS

| | | | |
|---|---|---|---|
| 1,542,097 | 6/1925 | Ripley | 83/303 |
| 1,575,223 | 3/1926 | Nordquist | 413/70 |
| 1,623,223 | 4/1927 | Widell | 413/12 |
| 3,142,280 | 7/1964 | Heinle | 413/12 |
| 4,504,181 | 3/1985 | Khoury | 413/17 |
| 4,763,807 | 8/1988 | Schreiber et al. | 220/274 |

FOREIGN PATENT DOCUMENTS

| | | |
|---|---|---|
| 0221447 | 12/1988 | European Pat. Off. . |
| 667248 | 9/1988 | Switzerland . |

*Primary Examiner*—Stephen Marcus
*Assistant Examiner*—Nova Stucker
*Attorney, Agent, or Firm*—Dennison, Meserole, Pollack & Scheiner

[57] ABSTRACT

According to the invention, a metallic product of a thickness less than or equal to 1 mm is compressed between a narrow elongated relief (2, 3) and an alternating succession of reliefs (10) and hollows (11) disposed opposite this narrow relief (2, 3), the differences in level between the said alternating reliefs (10) and hollows (11) being transverse in respect of the said narrow relief (2, 3), the compression stress being such that the minimum thicknesses of the said metallic product after compression are comprised between 0.01 and 0.15 mm. This method makes it possible to obtain tearing lines which have no injurious rough portions. The invention likewise relates to the products obtained and is particularly interesting in the field of packaging.

10 Claims, 6 Drawing Sheets

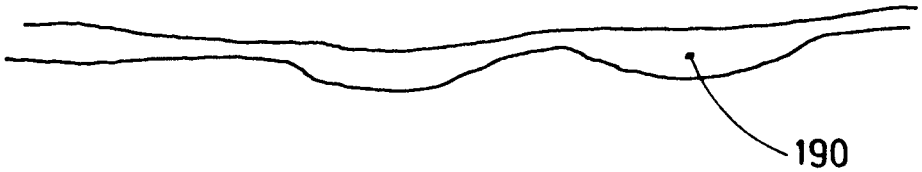
FIG. 8
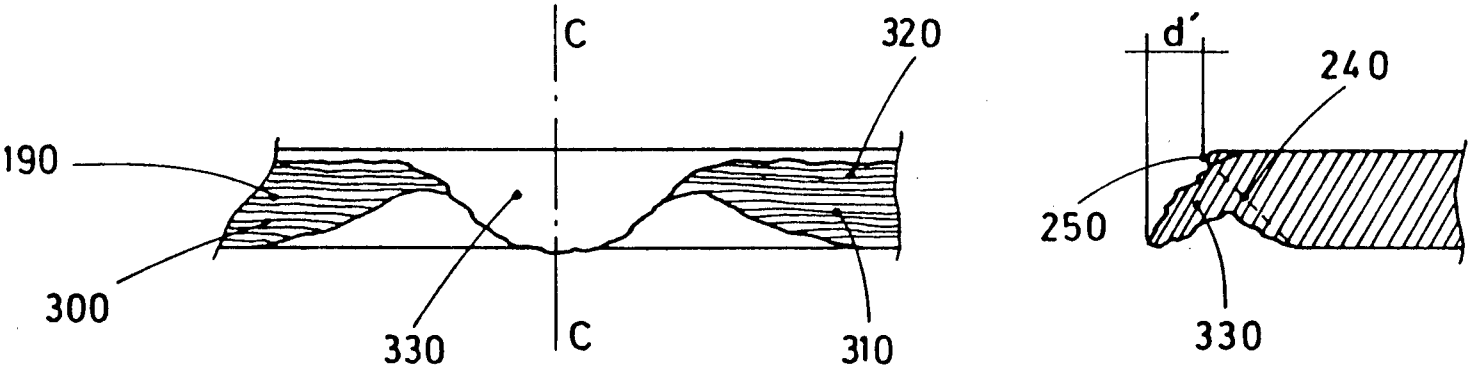
FIG. 9
FIG. 10

METHOD OF PRODUCING A NON-CUTTING TEAR-OFF LINE AND THE PRODUCTS OBTAINED

This application is a continuation-in-part of application Ser. No. 406,422, filed Sept. 11, 1989, now abandoned.

The present invention relates to a method of producing a means of easily tearing a thin metallic product.

This product is typically a sheet metal of a thickness less than or equal to 1 mm, or even a shaped thin product, such as a preserves can, or a stopper or closure means rendered inviolable by the said easy tear-off device. The invention also refers to the products obtained.

On cans or on closure or over-closure cap seals, of aluminium or tin, it is already known to use tear-off lines or lines of weakness obtained by a non-traversing cut or by a traversing cut in which there are breakable connecting bridges. For the user, these easy opening means can often cause accidental injury, the broken bridges or edges having small sharp edges or spots of roughness which can produce cuts.

The Applicants have sought to obtain tear-off lines which do not suffer from these disadvantages, that is to say which cannot cause injury once the cap is opened.

STATEMENT OF THE INVENTION

A first object of the invention is to provide a method of producing a tear-off line on a metallic product of a thickness less than or equal to 1 mm, characterised in that the said metallic product is compressed between a narrow elongated relief and an alternating sequence of reliefs and hollows disposed facing this narrow relief, the differences in level between the said alternating reliefs and hollows being transverse in relation to the said narrow relief, and the compression stress being such that the minimal thicknesses of the said metallic product after compression are between 0.01 and 0.15 mm.

This method has been tried out on aluminium of 99.5% purity and on aluminium alloy in both the annealed and the cold-hammered state, and the result is quite surprising: the tearing of products produced in this way produces edges and tear-off strips which have no rough patches likely to injure the fingers. The transformation caused by compression of the product between the particular reliefs according to the invention and its effect which does away with roughness which might offer a cutting edge are only imperfectly embraced by the tests and examinations described, but the essential conditions have been brought out so that the application of the method to any metallic product which present problems of cuts or injuries from the torn edge has to be proposed.

To sum up, the effect of the compression of the metallic product treated is as follows: the narrow elongated relief firmly presses the metallic product against any relief on which the product abuts and it then makes a deep notch therein, according to the nature and geometry of the narrow relief and the compression stress applied. Continually in space and possibly in time, the narrow elongated relief tends to push back the adjacent portion of the metallic product into the hollow which follows on from the relief, producing a flexion of the product in this hollow as a function of the length of the hollow, which is also the gap between two successive reliefs, with a smaller and possibly intermittent indentation of this adjacent portion.

It will be noted that these parts of the metallic product which are not or are only slightly indented ensure solidity in transport and the additional shaping operation(s), for example the shrinking of a capsule on the neck of a bottle. At the same time, these portions have to be easy to break, essentially by a shearing stress during the tear-off process. The object of the ensuing measures is to obtain an easily effected tear-off which leaves no harmful sharp or rough places although it does at the same time still offer adequate resistance to traction.

Generally speaking, the alternating relief and hollow portions used in the method according to the invention follow on at a pitch which is typically comprised between 0.5 and 10 mm, the gap between the reliefs, which is the length of the hollows in relation to the narrow elongated relief and which determines the length of the portions ensuring residual resistance to traction in the product, being comprised between 0.2 and 4 mm. For its solidity and for proper monitoring of the depths of indentation, the narrow elongated relief portion has a V-shaped profile with a total angle of 50° to 110° with an end radius of 0.03 to 0.15 mm.

If the metallic product is made from tin plate or aluminium or alloy, metal alloys which have approximately the same behaviour vis-a-vis tearing problems and the deformations described, and which is of a thickness comprised between 0.06 and 0.4 mm, the aforementioned measures remain valid and preferred conditions are stipulated hereinafter.

One interesting case is, then, that in which the product is a receptacle, for example a preserves can, or a capsule.

According to the present invention, the narrow elongated relief and the alternate reliefs and hollows are then carried respectively by an interior tool consisting of a mandrel or punch fitted into the body of the said receptacle or the said capsule and an outer body or tool, for example a roller which, upon compression, is caused to rotate in relation to the mandrel or punch which is coated with the product, the disposition of the reliefs between the mandrel and the roller possibly being reversed. The instantaneous compression then affects firstly the portion of the product which is clamped between the narrow relief portion and between the relief or reliefs carried respectively by these tools.

According to a first arrangement, it is possible then to place the narrow elongated relief on the mandrel or punch fitted with a typical radial clearance of 1 to 3 mm into the body of the said receptacle or the skirt portion of the said capsule, the alternate reliefs and hollows being carried by an exterior body, for example a roller.

Preferably, in this case but also as a general rule, the alternating relief and hollow portions take the shape of teeth having two parallel edges which make an angle of at least 20° with the direction of the narrow elongated relief in the compression position, these teeth alternating with hollows 0.3 to 1.5 mm long, the pitch (tooth+hollow) being 0.5 to 3 mm. Tooth edges which are virtually perpendicular to the direction of the elongated relief are preferred when a single tear-off line is being produced.

Normally, the product which is made from tin or aluminium or alloy is between 0.08 and 0.03 mm thick and the compression stress is so regulated that, after compression, the minimum thicknesses obtained are between 0.01 and 0.08 mm.

With regard to aluminium cap seals, the tear-off lines of which were produced according to this first arrangement, the original tests were continued over several hundred cap seals and a certain number of irregular tear-off lines were obtained.

A study of the faulty samples showed that sometimes the capsule had slipped in relation to the narrow elongated relief carried by the punch so that at the second turn of the cap seal in relation to the outer body, which is a loose roller carrying alternating reliefs and hollows, the tear-off strip already fashioned departed from the alignment of the said reliefs on the roller and the punch, the reliefs on the strip being damaged or destroyed. In other words, with this so-called reversed arrangement, the fashioning of a tear-off line over more than one turn resulted fairly evenly in damage to the said tear-off line.

It was found to be far better for mass production for the alternate reliefs and hollows to be carried by a mandrel or punch which, with a diametral clearance of less than 0.5 mm, was fitted into the body of the said receptacle or the skirt member of the said cap seal, the said narrow elongated relief being carried by the outer body which, upon compression, is caused to rotate in relation to the said mandrel or the said punch.

With this second arrangement, the results remain constantly good whatever may be the number of rotations of the cap seal in relation to the roller or outer body carrying the narrow elongated relief. During this work, the cap seal bears against the punch or mandrel by reason of the compression of the roller and it turns together with the mandrel. The result found is dubious because the arrangement now adapted places the succession of reliefs and hollows which produces the most inter-engagement on the inside of the mandrel while the elongated relief which permits of sliding is now on the outer tool, this arrangement furthermore providing for minimal clearance of the cap seal in relation to the mandrel, whereas in the first arrangement the presence of the narrow elongated relief on the mandrel necessitated a certain clearance. However, these remarks which are based on hindsight do not allow us to see the surprising result achieved: in other words, good quality tear-off lines regardless of the number of turns required to produce them, on substantial quantities of capsules.

According to an advantageous arrangement, the alternate reliefs and hollows forming a milled ring are carried by a rotating mandrel or punch and are disposed at right-angles to its axis of rotation and the narrow elongated relief is carried by a loose roller the axis of rotation of which is parallel with the axis of rotation of the mandrel during compressing, which locally clamps the body of the receptacle or the skirt member of the capsule against the said narrow elongated relief and the milled ring.

According to a particular case of the method which employs a rotary mandrel and loose roller, the mandrel carries two two milled rings and the roller carries two narrow peripheral reliefs which come into position opposite the said milled rings in such a way as simultaneously to produce the two tear-off edges of a tear-off tongue on the receptacle or capsule. The transverse edges of the teeth of the two milled rings may be either inclined symmetrically in relation to the direction of the peripheral reliefs of the spring in such a way as to grip the metal even better and in order to produce very parallel tear-off edges, these inclinations being typically 5° to 40° in relation to a line at right-angles to the direction of the peripheral reliefs, or not inclined.

The main invention also has as object the metallic products produced, of which the thickness is less than or is equal to 1 mm, comprising at least one tear-off line having on one face an indented line comprising deep portions of a thickness in the bottom of the notch of between 0.01 and 0.15 mm alternating with solid or less strongly indented portions of lengths along this line of indentation which are comprised between 0.2 and 4 mm, with a pitch comprised between 0.5 and 10 mm, while on their other face, at right-angles to this indented line, there are transverse marks which are accompanied by longitudinal undulations, both the former and the latter being of the same pitch as the deep portions of the line of indentation.

In the case of a product which consists of tin or aluminium or alloy and of which the thickness is typically comprised between 0.08 and 0.3 mm in the tear-off portion, the preceding values are preferably:

thickness at the bottom of the indentation of the deep portions of the line of indentation on the tear-off line: 0.01 to 0.08 mm;

unit length of the solid or slightly indented portions situated between the deep portions: 0.3 to 1.5 mm;

these deep portions of the line of indentation and these solid or slightly indented portions being disposed according to a repeated pitch of 0.5 to 3 mm.

When this product is a preserves can or a cap seal, the tear-off line according to the invention being situated on the body of the can or on the skirt of the cap seal, the indentation line of this tear-off line is according to the second arrangement situated on the outside face of this body or this skirt member and the corresponding longitudinal undulations and transverse markings are particularly visible on the inner face. In this case, just as much as in general, the outer surface on the side of the indentation likewise has small undulations, identification of the undulations on the other surface being, however, easier because they accompany the markings of this face by the transverse edges of the teeth which have compressed it.

In the case of such a body of a preserves can or a skirt of a cap seal, it is possible to have two tear-off lines which form the edges of a tearable tongue, as has already been indicated and illustrated hereinafter with reference to a new example.

The advantages offered by the invention are recalled as follows:

surprising production of tear-off lines which produce tears with no injurious rough portions;

these tear-off lines are fluid-tight, in contrast to lines of weakness which comprise bridges;

production is particularly simple, involving only current tools, and can be performed in a very short time: in other words, a single compression, particularly in the case of a flat product, or a rotary operation over one to just a few revolutions;

mechanical strength through the tear-off line is still sufficient.

The invention can be applied to all metals or alloys, the nature of which can lead to harmful rough places being caused by the bearing process. It is particularly important in the case of widely used packagings which are typically of tin or aluminium or alloy and which contain at least 97% Al.

EXAMPLES AND EXAMINATION

Figure 1:
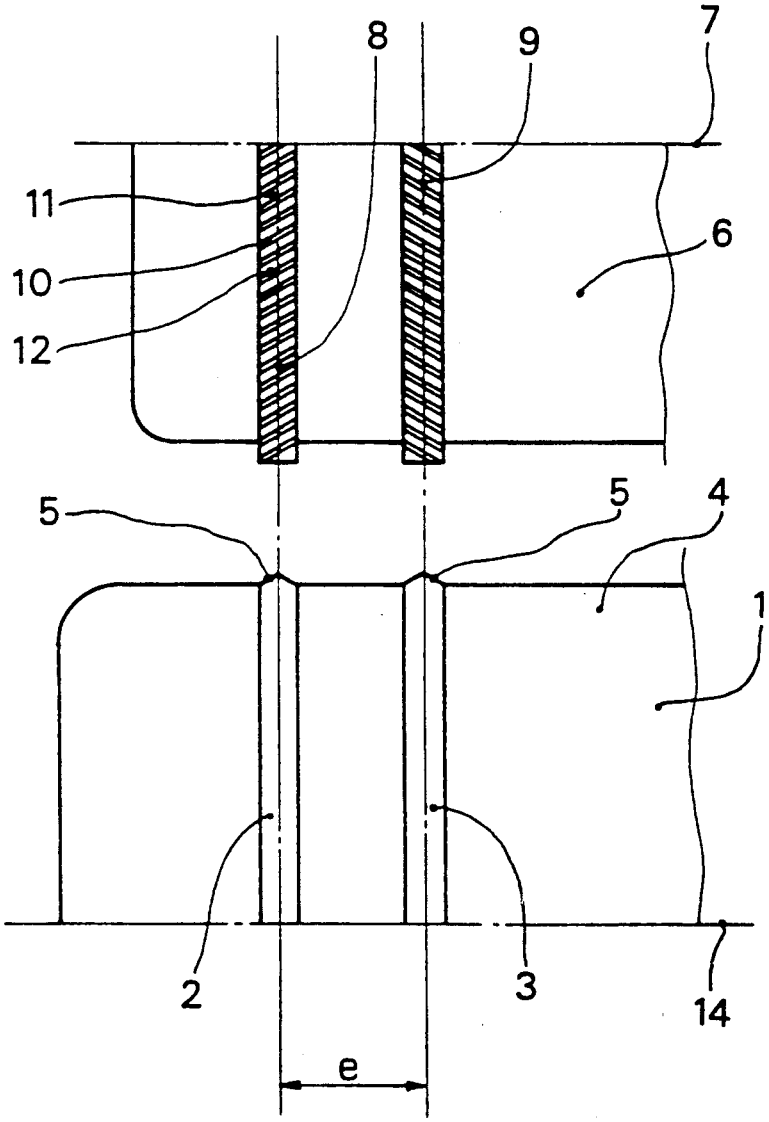
FIG. 1 shows the punch and the roller used in the tests according to the first arrangement, in a partial external view.

According to the thickness, FIG. 8 shows the contour of a torn tongue, on the profile projector.

FIG. 9 shows the broken portion of such a tongue.

FIG. 10 is a section at right-angles to the previous view passing through the centre CC of its portion which has been broken by shearing.

EXAMPLE 1

This example relates to slightly alloyed Al cap seals (Standard 1050 of the Aluminium Association) with a skirt of thickness 0.14 mm and an inside diameter of 29.5 mm close to the head, at the level of the tear-off tongue which is going to be shaped.

Attempts have been made previously to produce tongues on similar cap seals, which are capable of tearing along two internally indented edges with a thickness (at the bottom of the indentation) of 0.02 mm: tearing is easy but the torn edges can cut and make this solution unacceptable.

Here, the capsules have been additionally shaped, using according to the invention (FIG. 1):

a rotary mandrel or punch 1 of a diameter of 28 mm and carrying two peripheral and parallel relief portions 2 and 3, the distance between their centres 3 being 7 mm, projecting from the cylindrical surface 4 of the punch 1 by 0.4 mm and having end profiles 5 which are V-shaped at 90° with a rounded tip of 0.05 mm;

and a wheel or roller 6 mounted to idle on its axis of rotation 7, carrying two parallel milled rings 8 and 9, their distance between centres being 7 mm and their width being 2 mm and which, furthermore, protrude from the wheel 6 and having oblique teeth with a pitch of 1 mm with teeth 10 which are 0.4 mm long in the direction of the milled rings.

The height of the teeth 10 was 0.5 mm and the hollows 11 between the teeth, 0.6 mm long, had inclined edges. The transverse edges 12 of the teeth 10 were at +30° and −30° in relation to the main direction of the milled rings 8 and 9 as shown in FIG. 1.

Figure 2:
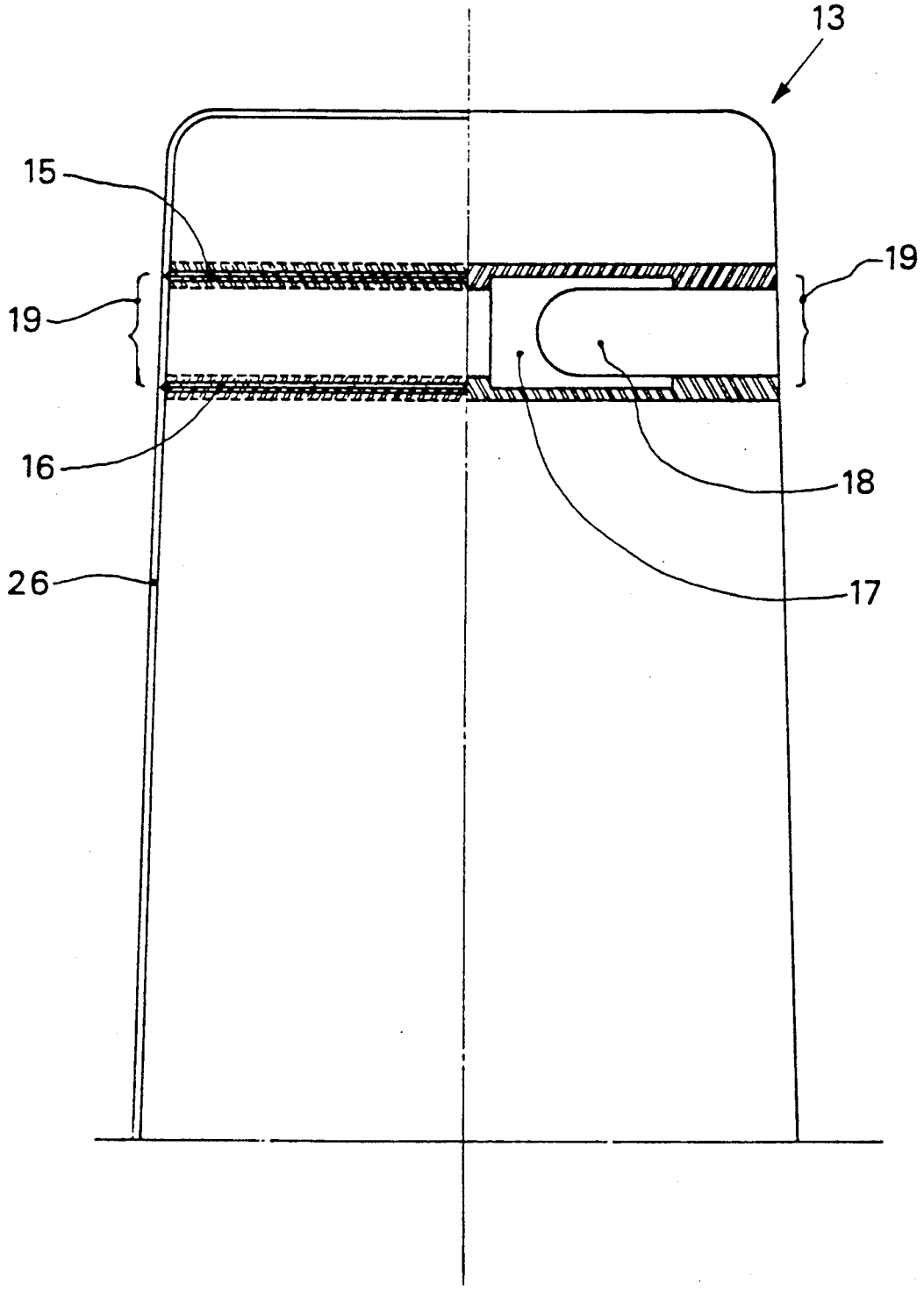
FIG. 2 shows a cap seal with its tear-off tongue obtained by the first arrangement, seen from the outside in the right-hand half and from the inside in the left-hand half.

For shaping the tear-off lines, a cap seal 13 (FIG. 2) was fitted over the punch 1 and the punch 1 was rotated at 1485 rpm and the roller 6 was applied against it, the axis of rotation 7 of this roller 6 being parallel with the axis of rotation 14 of the roller 8 or 9 being at the level of the V-shaped end profile 5 of a peripheral relief portion 2 or 3 on the punch 1. The stress with which the punch was applied was 4 daN. The compression was stopped for each cap seal after a variable number of revolutions, the minimum being one revolution. This number of revolutions had no effect on the behaviour upon being torn. After shaping of the tear-off lines 15 and 16, the aperture 17 was additionally stamped and the starter or end 18 of the tear-off tongue 19 is thus completely prepared. The tearing edges of this tongue 19 cannot be seen from the outside (the right-hand half of FIG. 2).

The tearing tests carried out on several hundred cap seals resulted in uneven tearing as has already been described and explained in the general disclosure.

EXAMPLE 2

Additional shaping of capsules identical to the foregoing was carried out by using, according to the second arrangement proposed by the invention (FIG. 3):

a roller 101 adapted to idle about its axis of rotation 140 carrying two parallel peripheral reliefs 20 and 30, their distance between centres e' being 15 mm and exceeding the cylindrical surface 40 of the roller 101 by 0.5 and having an end profile 50 of a V at 90° to a flat portion 0.02 mm.

a conical punch 60 or mandrel adapted to rotate about an axis 70 carrying two parallel and flush milled rings 80 and 90 of which the distance between centres if 15 mm with a 2 mm width of oblique teeth with a pitch of 1 mm and with teeth 100 of a width 0.2 mm.

The height of the teeth 100 was 0.9 and the hollows 110 between teeth of width 0.8 mm with inclined edges. The transverse edges 120 of the teeth 100 represented +10° and −10° in relation to the axis of the punch 60 respectively for each of the milled rings 80 and 90.

For the shaping of tear-off lines, a cap seal 130 (FIG. 4) was fitted over the punch 60, the cap seal matching the punch without clearance. The punch 60 was caused to rotate at 1200 r.p.m. and against it was applied the roller 101, the axis of rotation 140 of this roller 101 being parallel with the generatrix 325 of the rollers 80 and 90 to the punch 60. The roller applied a stress of 4 daN.

Compression by this roller was stopped for each cap seal after a variable number of turns and at least one turn. This number of turns had no effect on the behaviour at tearing. After shaping of tear-off lines 150 and 160, the aperture 170 was additionally punched out and the start or finish 180 of the tear-off tongue 190, preparation of which was thus completed.

Figure 4:
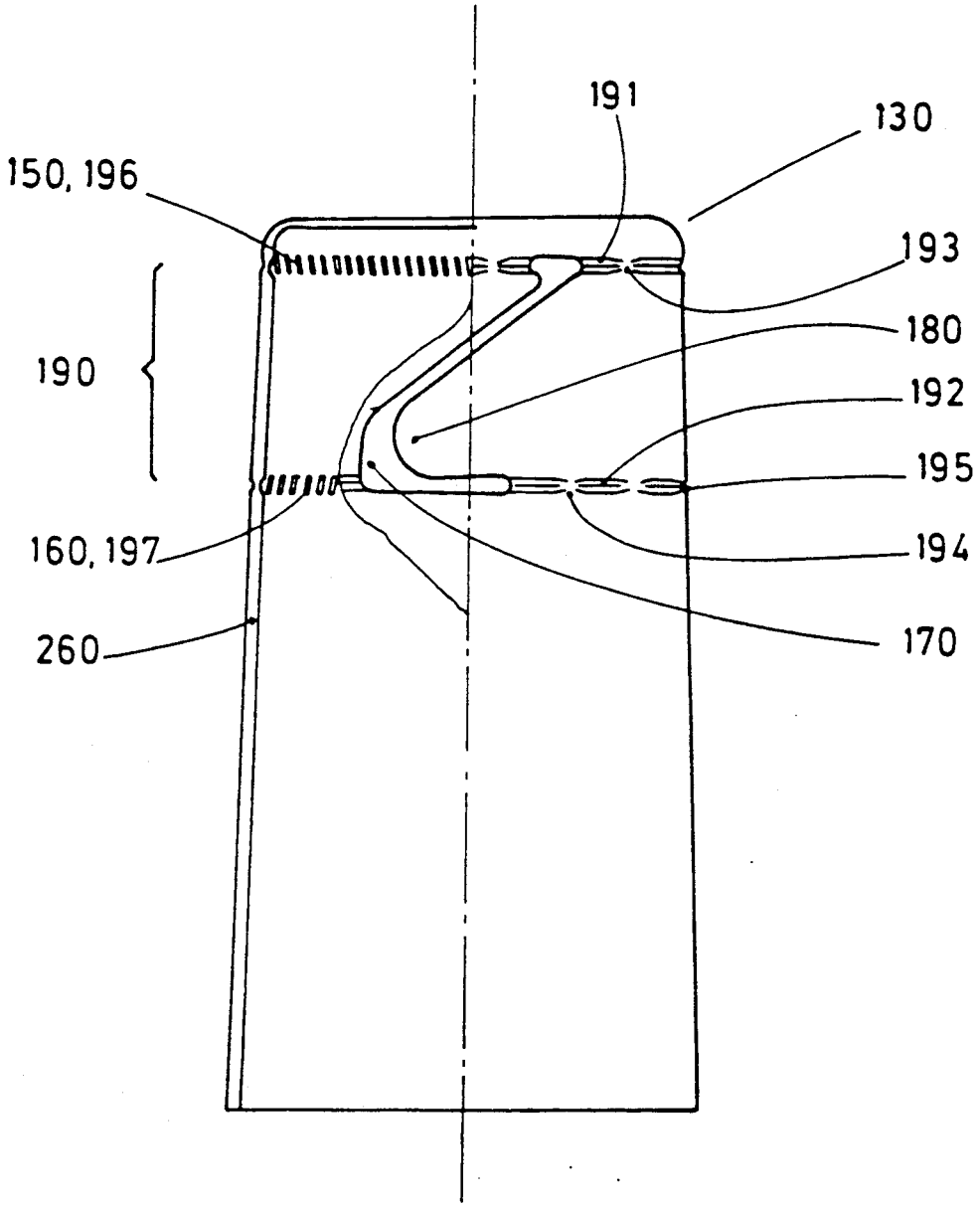
FIG. 4 shows a corresponding cap seal with its tear-off tongue seen from the outside on the right-hand half and from the inside on the left-hand half.

The tear-off edges of this tongue 190 can be seen from the outside (right-hand half of FIG. 4). The two outer notched lines 191 show alternately deep portions 192 and retracted portions such as 193, 194 and 195, these latter corresponding to the small inner reliefs 196 and 197 on the tear-off lines 150 and 160 (left-hand half in FIG. 4).

RESULTS OF TEARING AND EXAMINATIONS

Figure 5:
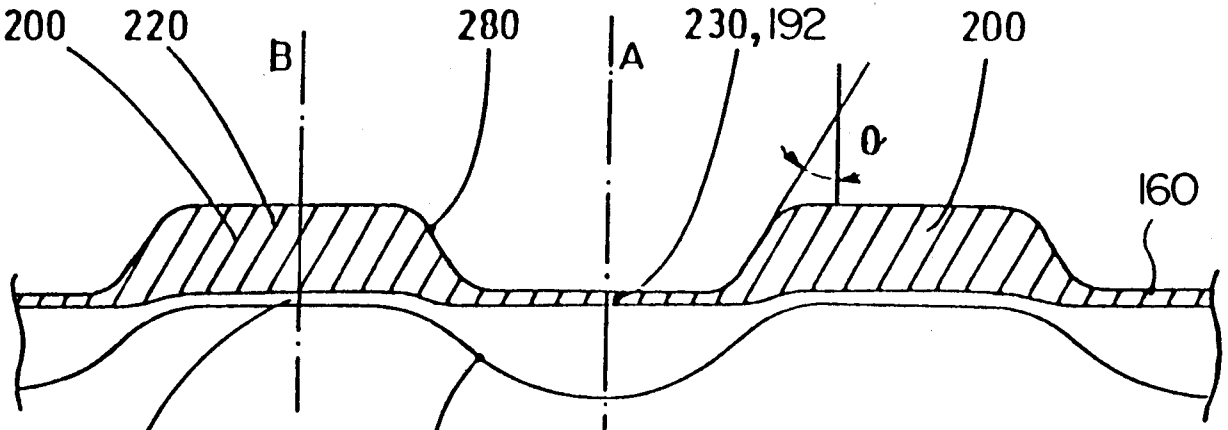
FIG. 5 shows a section according to the axis of a tear-off edge of the aforementioned tongue.
Figure 7:
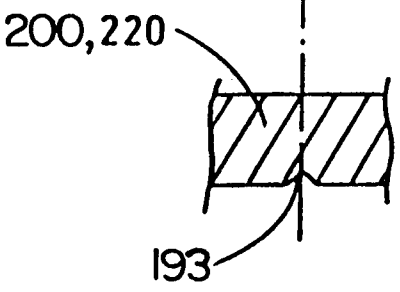

FIG. 5 shows a longitudinal section through a tear-off line or zone 160 passing through the line of indentations produced by the end 50 of the V-shaped 90° profile of the peripheral portion 30 of the roller 60 (FIGS. 3 and 4), it is possible more precisely to show the alternation of aluminum portions 200 comprising in the cutting plane an indentation 193 of minimal depth 0.02 mm (FIG. 7) with a non-indented thickness 220 of 0.14 mm and with heavily indented portions 230 which have in the bottom of the notch a residual thickness of 0.02 mm with a thickness of 0.16 mm at the edge of the notch.

Figure 3:
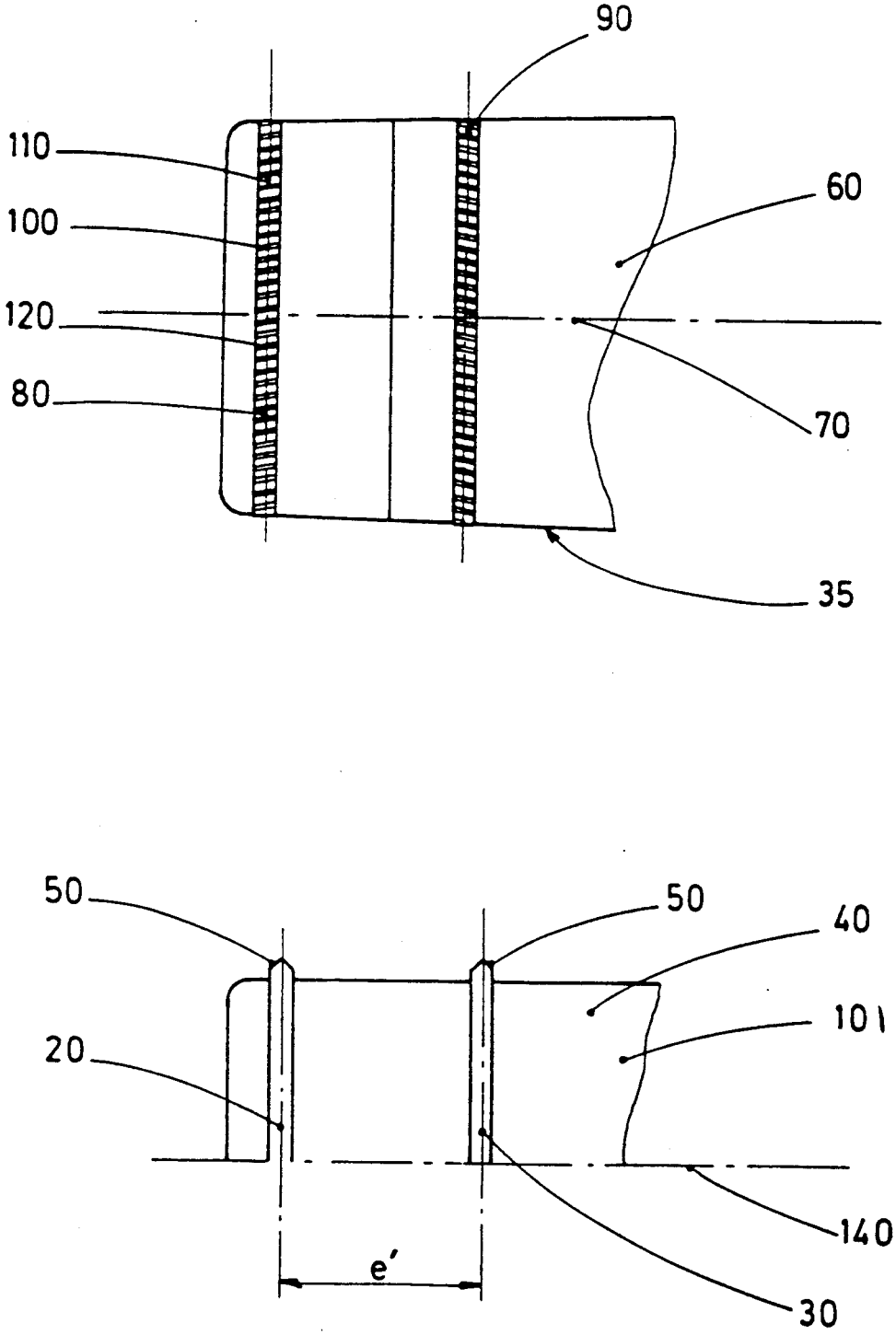
FIG. 3 shows the punch and roller used in the tests, produced in accordance with the preferred embodiment and in a partial exterior view.
Figure 6:
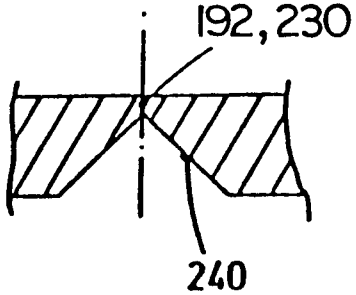
FIGS. 6 and 7 show two cross-sections through the tear-off zone or line at right-angles to the aforementioned section and passing respectively through the lines AA and BB.

FIG. 6 shows the profile of the notch or corresponding groove 240 with the bottom of the indentation 192 having a thickness of 0.02 mm thick. FIG. 5 shows that the deformations caused by the compression of the skirt member 260 of the cap seal 130 between the relief 30 and the milled ring 90 shown in FIG. 3 are: longitudinal undulations 270 of the right and reverse surfaces of the compressed zone and its surroundings, visible behind the longitudinal cross-section, the sudden changes in slope 280 which correspond to the impact of the transverse edges 120 of the teeth 100 (FIG. 3) being reflected in or consisting of marks which are particularly visible on the outer face of the capsule 130. The edges which are at an angle $\theta = 30°$ of the not too heavily indented portions 200 correspond to the inclined edges of the hollows 110 in the milled ring 90. The pitch of the portions 200 and 230 is 1 mm as is the pitch of the relief portions 100 of this ring 90.

Tests involving tearing of the tongues 190 on fifty cap seals 130 prepared by the method set out in Example 2 all produced slightly rough but non-cutting tears. FIG. 8 shows the contour of a tongue 190 torn according to its thickness at the profile projector: the apparent thickness ranges from 0.07 to 0.22 mm, which is due essentially to the deformations already mentioned and those caused by the tearing.

In FIG. 9 which shows a part of the torn edge 290 of the tongue 190, the two zones 300 and 310 which show longitudinal striations 320 correspond to a surface which is at 45° to the two adjacent deep notches 240, while the intermediate zone 330 corresponds to broken and non-indented metal. The striations 320 are due to the forcing-in of the relief portion 30 of the roller. With the perpendicular cross-section in FIG. 10, it can be seen that this broken metal 330 takes the form of a turned-back lip which is continuous with the broken bottom of the indentation 192 in the heavily indented portion (FIGS. 10 and 9). The offset between the tip of the lip 330 and the tear in the bottom of the indentation 192 is 0.10 mm.

Thus, for the tear-off lines according to the invention, this particular method of rupture and the differences in level in the tearing zones would appear to play a vital role in the non-injurious nature of the torn edges.

EXAMPLE 3

Five cap seals were taken having the same geometry as the aforementioned cap seals and they consisted of aluminium alloy to the grade 8011 laid down by the A.A. (with approx. Si 0.7% and Fe 0.8%) in the state H24, that is to say half-hard, these cap seals being fresh from the drawing and ironing stage.

These cap seals were shaped in the same way as in Example 2, with the same compression stress. The minimum thicknesses of the bottoms of the grooves are a little larger, from 0.04 to 0.05 mm. The tearable tongues can be torn without producing any injurious rough places, with edges soft to the touch as previously, but the tearing effort required is a little greater.

To return to a lesser effort in the case of this half-hard condition, it is possible in particular: to increase the compression stress to return to minimal thicknesses in the bottoms of smaller grooves; or to lengthen the teeth or to shorten the hollows between teeth. This example shows that the method according to the invention makes it possible to adapt to various situations.

We claim:

1. A metal can having a thickness less than or equal to 1 mm and inner and outer surfaces, comprising at least one tear-off line producing torn edges without harmful rough portions, the tear-off line having on said outer surface a line of indentations comprising deep portions in which the metal has a thickness of 0.01 to 0.08 mm, alternating with portions which are non-indented or less deeply indented and which have a length of 0.3 to 1.5 mm, said line of indentations having a pitch of 0.5 to 3 mm, the inner surface of said can having, directly opposite to said line of indentations, a line of transverse marks and longitudinal undulations having the same pitch as said line of indentations.

2. A can according to claim 1, formed of tin-plate or aluminum and having a thickness of 0.08 to 0.3 mm.

3. A can according to claim 1, which is a preserves can.

4. A can according to claim 1, comprising two said tear-off lines which form the edges of a tearable tongue.

5. A metal cap seal having a thickness of less than or equal to 1 mm inner and outer surfaces, and a skirt portion, said skirt portion comprising at least one tear-off line without harmful rough portions, the tear-off line having on said outer surface a line of indentations comprising deep portions in which the metal has a thickness of 0.01 to 0.08 mm, alternating with portions which are non-indented or less deeply indented, and which have a length of 0.3 to 1.5 mm, said line of indentations having a pitch of 0.5 to 3 mm, the inner surface of said cap seal having, directly opposite to said line of indentations, a line of transverse marks and longitudinal undulations having the same pitch as said line of indentations.

6. A cap seal according to claim 5, formed of tin-plate or aluminum and having a thickness of 0.08 to 0.3 mm.

7. A cap seal according to claim 5, comprising two said tear-off lines which form the edges of a tearable tongue.

8. A metal sheet having a thickness less than or equal to 1 mm, front and back surfaces, and at least one tear-off line producing torn edges without harmful rough portions, said tear-off line comprising on the front surface of said metal sheet, a line of indentations comprising deep portions in which the metal has a thickness of 0.01 to 0.08 mm, alternating with portions which are non-indented or less deeply indented and which have a length of 0.3 to 1.5 mm, said line of indentations having a pitch of 0.5 to 3 mm, the back surface of said metal sheet having, directly opposite to said line of indentations, a line of transverse marks and longitudinal undulations having the same pitch as said line of indentations.

9. A sheet according to claim 8, formed of tin-plate or aluminum and having a thickness of 0.08 to 0.3 mm.

10. A sheet according to claim 8, comprising two said tear-off lines which form the edges of a tearable tongue.

* * * * *